United States Patent [19]

Brackmann, Jr. et al.

[11] Patent Number: 4,880,390

[45] Date of Patent: Nov. 14, 1989

[54] PRESSURE COMPENSATED INTERMODULE TOWED ARRAY CONNECTOR

[75] Inventors: Walter H. Brackmann, Jr., Apple Valley; Cornelius A. Van Gelder, Fullerton; Roman A. Halushka, Santa Monica, all of Calif.

[73] Assignee: Hughes Aircraft Company, Los Angeles, Calif.

[21] Appl. No.: 262,456

[22] Filed: Oct. 25, 1988

Related U.S. Application Data

[63] Continuation of Ser. No. 83,910, Aug. 6, 1987, abandoned, which is a continuation of Ser. No. 682,571, Dec. 14, 1984, abandoned, which is a continuation of Ser. No. 30,810, Apr. 17, 1979, abandoned.

[51] Int. Cl.[4] ..... H01R 13/523

[52] U.S. Cl. ..... 439/204; 439/199

[58] Field of Search ..... 339/117 R, 117 P, 36; 439/190–195, 199–204

[56] References Cited

U.S. PATENT DOCUMENTS

| | | | |
|---|---|---|---|
| 2,647,939 | 8/1953 | Paluev | 439/201 |
| 3,729,699 | 4/1973 | Briggs et al. | 439/199 |
| 3,845,450 | 10/1974 | Cole et al. | 439/141 |
| 4,174,875 | 11/1979 | Wilson et al. | 439/190 |

*Primary Examiner*—Neil Abrams

*Attorney, Agent, or Firm*—William J. Streeter; Wanda K. Denson-Low

[57] ABSTRACT

Communication of fill fluid in a module hose with an interconnector junction between connectors is established when the two modules are coupled together. A fluid path 80 incorporating a normally closed valve (86, 88) extends between the mating face (94) of at least one connector (78) and its hose while the mating face of the other connector or coupling (68) incorporates a valve opening member (108) which opens the normally closed valve when the two connectors are joined so that fluid from one of the hoses flows to equalize the underwater pressure exerted on the joint between the connectors.

20 Claims, 4 Drawing Sheets

PRESSURE COMPENSATED INTERMODULE TOWED ARRAY CONNECTOR

This is a continuation of copending application Ser. No. 83,910 filed Aug. 6, 1987, in turn a continuation of Ser. No. 682,571 filed Dec. 14, 1984, which is a continuation of application Ser. No. 030,810 filed Apr. 17, 1979, all three are now abandoned.

BACKGROUND OF THE INVENTION

1. Field of the Invention

The present invention relates to an intermodule coupling mechanism and, in particular, to such a coupling mechanism which equalizes external and internal pressures exerted upon the coupling between electrical and similar connectors.

2. Description of the Prior Art

Coupling mechanisms of the type described are generally used in the assembly of long towed hydrophone arrays which are used, for example, in oil exploration and ship detection using acoustic means. For practical handling, fabrication and at sea sparing reasons, long towed array hydrophone arrays must be made in modular lengths which can be coupled together. It is desirable that the coupling be smooth, rigid and the same diameter as that of the flexible hose of which the modules are constructed, be of short length, light in weight, and easily manufactured. It should also have high reliability and a design which allows assembly from the outside without access to the back side of the coupling after it is installed on the module hose.

In the past, module couplings have been designed so that an air gap exists between the two halves of the coupling. This design has the advantage of allowing modules to be sealed at each end so that the "fill fluid" used to fill each module hose, comprising a light oil like hydrocarbon insulating liquid, is completely contained and so that the uncoupled module will be handled as an essentially dry unit. This simplifies assembly and disassembly of the fluid filled towed array. The electrical path between modules has normally been completed with a pigtail connector cable. This cable runs between the male and female pressure tight feedthrough connector, which penetrates the bulkhead fluid barrier located in each mechanical coupling half, and is joined in the sealed air chamber between them.

The disadvantage of this type of module end coupling design is the complexity and expense resulting from having to make two pressure-proof electrical connectors per joint. Since the array modules often operate at ocean depths of five to ten thousand feet, each electrical connector, which penetrates the "fill fluid" retaining bulkhead and reaches into the air space between the couplings, must be able to withstand a hydrostatic pressure of 2500 to 4500 psi. Such pressure is due to the fact that the rubber hose transmits the sea water hydrostatic pressure to the "fill fluid" through the flexible hose walls. On the other hand, the intercoupling air space is at atmospheric pressure, because the coupling joint was made and sealed in air above the surface of the water. The resulting pressure differential not only requires an expensive electrical connector but has been found to be the weakest link in array construction, from the point of view of reliability.

While it may be desirable to add "fill fluid" at the time of assembly to fill the intercoupling air space, complete filling is not possible. Thus, any remaining air allows a pressure differential to develop between the two sides of the electrical connector as before. Even if complete filling were possible, the low temperatures encountered in the ocean reduce the volume of the fill fluid, resulting in the same effect.

Another possibility is to separate the two rigid halves of the coupler slightly and bridge the gap with a piece of flexible hose. Now, when the space between the couplers is almost "completely" oil filled, any minor voids are unimportant because the flexible portion deflects, allowing the sea water hydrostatic pressure to be transmitted to the "fill fluid" oil between the coupling. In this situation, the fill fluid on either side of the electrical connector feedthroughs is balanced. Since no pressure differential exists, a lower cost connector can be used along with overall lighter construction of the coupling walls.

The disadvantages of this approach are that the rather large volume of "fill fluid" oil in between the connectors must be drained and refilled each time a set of modules is decoupled. Thus, the module is essentially "wet" and inconvenient to handle, particularly at sea. Also, the oil that has replaced the air does not provide light weight coupling, which is desirable, although this situation is partially offset because a lighter overall construction is now satisfactory.

In summary, towed array module mechanical/electrical connectors have been used which withstood hydrostatic pressure across the wet to dry bulkhead of up to 3000 pounds. However, experience revealed that this has induced electrical connector failures in the situation where extremely high reliability is required. Alternate pressure compensated connections using a separate piece of coupling hose have been crude and complex to mate and require separate filling.

SUMMARY OF THE INVENTION

The present invention overcomes and avoids these and other problems by incorporating an automatic valve action to provide communication of the fill fluid in the module hose with the interconnector junction crack between the connectors when the two modules are coupled together. In its preferred embodiment, a fluid path incorporating a normally closed valve extends between the mating face of at least one connector and its hose while the mating face of the other connector incorporates a valve opening member which opens the normally closed valve when the two connectors are joined so that fluid from one of the hoses flows to egualize the underwater pressure exerted on the joint between the connectors.

It is, therefore, an object of the present invention to provide for a coupling design which eliminates hydrostatically induced electrical connector failures.

Another object is to provide for such a coupling of relatively small cost.

Another object is to provide for such a coupling having a relatively small size and with a very small interface space into which the "fill fluid" must flow.

Another object is to minimize the time and maximize the ease with which the coupling can be made under sometimes adverse sea conditions.

Another object is to provide for such a coupling which takes advantage of pressure balance across the electrical connectors penetrating the bulkhead of the connecting module ends while allowing it to be handled essentially as a dry coupling.

Another object is to permit use of a wider choice of connectors without special consideration as to their ability to withstand high pressures.

Another object is to eliminate the need for a pigtail between the two electrical connectors by providing direct interface between the connector halves.

Still another object of the present invention is to fill the space between the two couplings, which are not occupied by the connectors, with a means which incorporates a valve.

Other aims and objects as well as a more complete understanding of the present invention will appear from the following explanation of exemplary embodiments and the accompanied drawings thereof.

DESCRIPTION OF THE PREFERRED EMBODIMENTS

Figure 1:
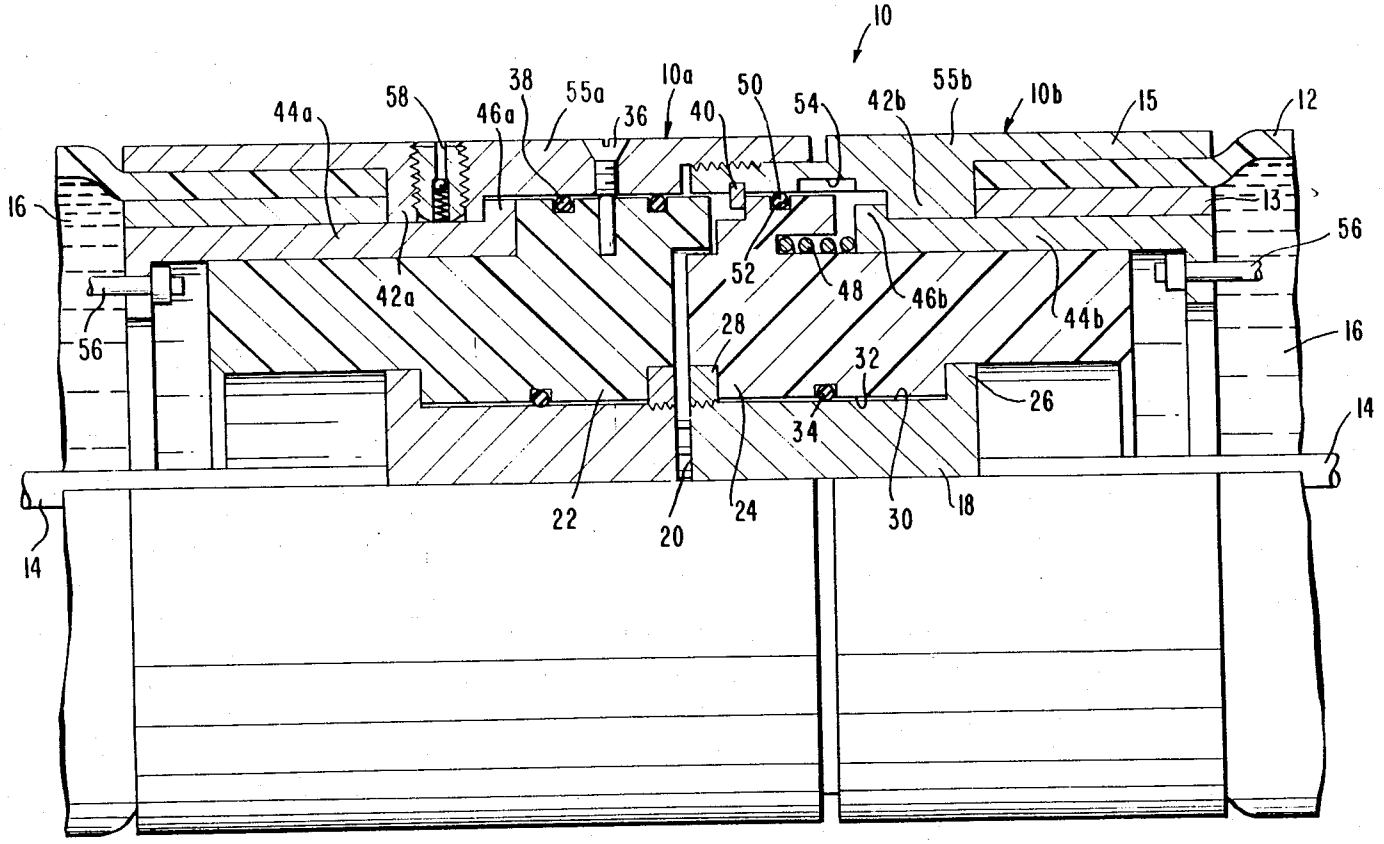
FIG. 1 is a view of a first embodiment of the present invention.
Figure 2:
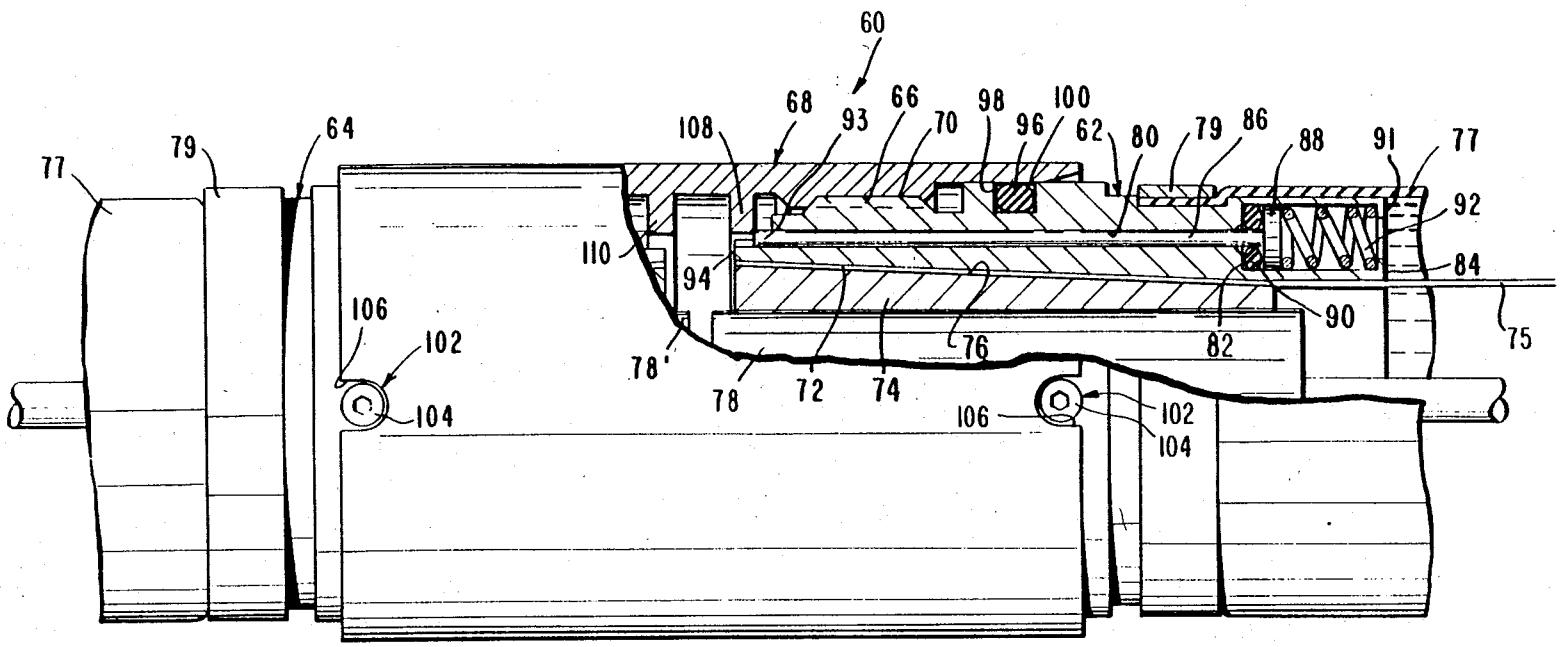
FIG. 2 is a view of a modified embodiment of the present invention depicting the modules in partially coupled position.
Figure 3:
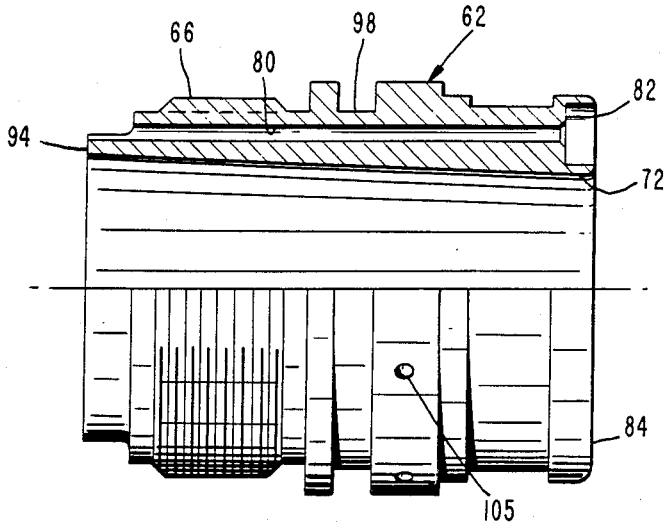
FIG. 3 is a view of one of the headers of the embodiment shown in FIG. 2.

Accordingly, with reference to FIG. 1, a pressure-compensated underwater intermodule coupling mechanism 10, comprising a pair of headers or coupling halves 10*a* and 10*b*, couples a pair of module hoses 12 together. A plurality of such hoses are secured together by a plurality of coupling mechanisms 10 to create a long fillable array of hydrophone arrays. The hoses are designed not only to house electrical or other conductors 14 but also to contain an insulating "fill fluid" 16, which may comprise a light oil like hydrocarbon fluid. The electrical conductors terminate in connectors 18 which interface at their mating faces 20 in a normal manner.

Surrounding connectors 18 respectively are lightweight pressure resistant blocks 22 and 24, which are rotatably retained on their connectors respectively by shoulder 26 integral therewith and a retaining ring 28 threadedly engaged to its connector. Shoulders 26 and retaining rings 28 define a circumferential groove 30 on each connector which cooperates with an annular projection 32 respectively on blocks 22 and 24 so that the electrical connectors are held fixed in an axial position but are permitted rotation with respect to their blocks. O-rings 34 are positioned between grooves 30 and projections 32 to function as fill fluid seals.

Blocks 22 and 24 may be constructed of any suitable material, preferably a syntactic foam which is light and capable of withstanding high pressures. Block 22 is affixed to mechanism half 10*a* by means of a plurality of retaining screws 36 placed around the circumference thereof. A pair of O-rings 38 are positioned on either side of screws 36 as fill fluid seals between bulkhead block 22 and coupling mechanism half 10*a*.

Bulkhead block 24 is disposed to have limited axial movement within its coupling mechanism 10*b* between an annular front stop 40 comprising a snap ring and a rear stop. This rear stop comprises a combination of an inwardly extending annular shoulder 42*b* and a strength member support cup 44*b*. Cup 44*b* is provided with an outwardly extending flange 46*b* which, with shoulder 42*b* provides a rear stop for bulkhead block 24. A spring 48 extends between cup flange 46*b* and bulkhead block 24 to bias the bulkhead block against snap ring 40 in its forward position.

An O-ring 50 is carried within a retaining groove 52 in bulkhead block 24 and provides a fill fluid seal against coupling mechanism 10*a*. Slightly spaced rearwardly of O-ring 50 are preferably three or more longitudinally extending grooves 54 in an outer shell 55*b*of coupling mechanism half 10*b*.

A similar intra module strength member support cup 44*a* having an annular flange 46*a* is held captive between annular shoulder 42*a* of a shell 55*a* in coupling mechanism half 10*a*. Flange 46*a* abuts against shoulder 42*a* and is retained therein. Strength members 56 are respectively secured to their support cups 44*a* and 44*b* in order that undue tension is not exerted upon electrical conductors 14.

The operation of the embodiment disclosed in FIG. 1 is based upon the concept of providing a coupling which, when completely mated, interleaves in such a manner that only a very small volume between the coupling halves remains to be filled with oil. The very small amount of oil needed is supplied to the coupling voids from the fill fluid in hose 12 of mechanism half 10*b*. Fluid is allowed to flow into the void only when the coupling is almost completely mated. At this time, circular block 24 of syntactic foam is slightly pushed back by contact with block 22 against the bias of retaining spring 48 to create a leak path into the coupling joint between connector faces 20. This leak path exists as long as the coupling is mated, and results from movement of bulkhead block outer seal O-ring 50 back across longitudinal grooves 54. This path allows the small voids in the coupling interface to be continuously equalized or pressure compensated by the fill fluid in the module. The module fill fluid is nearly at sea pressure for any depth since the soft resilient module hose wall 12 communicates the hydrostatic pressure to fluid 16. Under these conditions there is never a hydrostatically induced load across the electrical connector or the syntactic foam block bulkhead.

When the module joint is decoupled, syntactic foam block 24 is moved forward by spring 48 to reseal the module so it can be stored and handled essentially dry. The small amount of fluid which remains in the small coupling voids can be wiped away with a cloth.

Normally towed array modules are pressurized to 10 to 30 psi. As a joint is decoupled, a measured amount of fluid will be lost. After repeated decouplings, enough fluid may be lost to significantly reduce the pressure within the module. To replace this lost fluid, a fill valve 58 is provided in the perimeter of the coupling half 10*b*. In addition, this valve is normally required to allow periodic replacement of the fill fluid which has been found to slowly diffuse through the module hose walls.

An alternate approach to providing a leak path between the coupling joint and the module is to include a valve, such as a Schrader, reed or plug valve which communicates through the coupling bulkhead block to the module fill fluid. It is spring loaded to remain closed until the coupling is nearly mated. In this approach, bulkhead block 24 is firmly mounted. The use of discrete valve versus an integral valve design, however, reduces the size of the electrical connector that may be used, as it occupies a portion of the diameter which may be undesirable in some coupling configurations.

The electrical connector used may be a single concentric coaxial or triaxial connector mounted in the center of the coupling. This would allow the module coupling halves to be interlocked using a breach lock or French interrupted thread design, because the rotation of the two module halves, required to mechanically couple the joint together, would not misalign or damage the electrical connection.

For a pin type electrical connector, several alternate designs are usable. One employs a captured threaded ring, secured to one connector half. The ring is then screwed onto the right hand connector half while being free to rotate on the left coupling half. The connector is keyed so that the electrical pins properly mate.

Another alternate is to use a breach lock type mechanical connection while allowing one of the electrical connectors to rotate in the syntactic foam bulkhead block. The electrical connector is built with a protruding keyed shell. Its dimensions are such that keyed electrical connector shell halves begin to slip over each other before the mechanical connector begin to mate or require alignment.

The embodiment of FIG. 1, therefore, is a coupling design which provides the advantages of pressure balance across the electrical connectors penetrating the bulkhead of each module end while allowing it to be handled essentially as a dry coupling. In addition, it eliminates the need for a pigtail between the two electrical connectors by providing direct interface between the male and female connector halves. Further, the space between the two couplings, not occupied by the male and female electrical connectors, is filled with syntactic foam. This material, although not as light as air, is significantly lighter than the fill fluid and will withstand high pressure.

Referring now to FIGS. 2–5, which show the preferred embodiment of the present invention, a pressure-compensated underwater intermodule coupling mechanism 60 comprises a pair of module headers 62 and 64, each having external threads 66, joined by a tubular coupling 68 at its mating threads 70. Both headers 62 and 64 are tubular in configuration having an interior conical surface 72 into which a swage ring 74 fits. Swage ring 74 is provided with an outer conical surface 76 which is adapted to cooperate with conical surface 72 to hold and retain module hose strength members 75. Connectors 78 and 78' are received within their respective module headers and are rotatably held therein by swage ring 74. Electrical conductors extend from the connectors in the usual manner. Hoses 77 are secured by connecting bands 79 to headers 62 and 64.

Both module headers 62 and 64 are constructed in an identical manner with the exception, if desired, of a fluid path incorporating a normally closed valve As shown herein, module header 62 is provided with an axially extending bore 80 terminating in an enlarged bore 82 at a rear face 84 of the header. A valve stem 86 is positioned in bore 80 and is provided with a head 88 which resides within enlarged bore 82. Between the valve head and the bottom of enlarged bore 82 at the terminus of axially extending bore 80 is an O-ring 90. The valve head is normally biased against O-ring 90 to seal bore 80 by means of a spring 92. A snap ring 91 in enlarged bore 82 retains spring 92 in place. When so biased, an end 93 of the valve stem extends beyond bore 80 at the front face 94 of module header 62.

Proper sealing between headers 62 and 64 respectively with coupling 68 is effected, as illustrated for header 62, by an O-ring 96 which is carried within an annular recess 98 and which bears against the cooperating inner surface 100 of coupling 68.

Further included on the respective peripheries of headers 62 and 64 are screws 102 having enlarged heads 104. Each screw is adapted to be screwed into a threaded hole 105 (see FIG. 3) of its respective header after the headers have been coupled together by means of coupling 68, at which point, heads 104 are received within slots 106 in coupling 68. Thus, engagement between screws 102 and slots 106 provide a locking engagement which precludes disengagement between the headers and the coupling.

Figure 4:
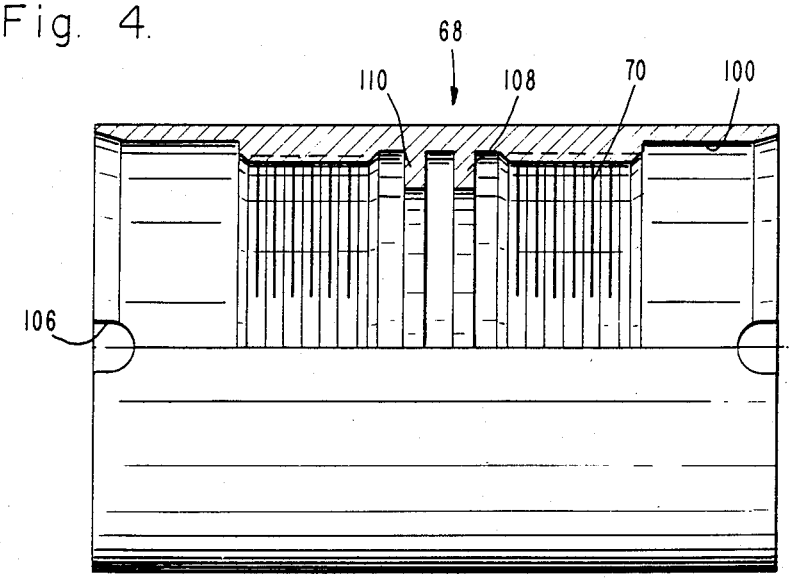
FIG. 4 is a view of the coupling ring depicted in the embodiment of FIG. 4.
Figure 5:
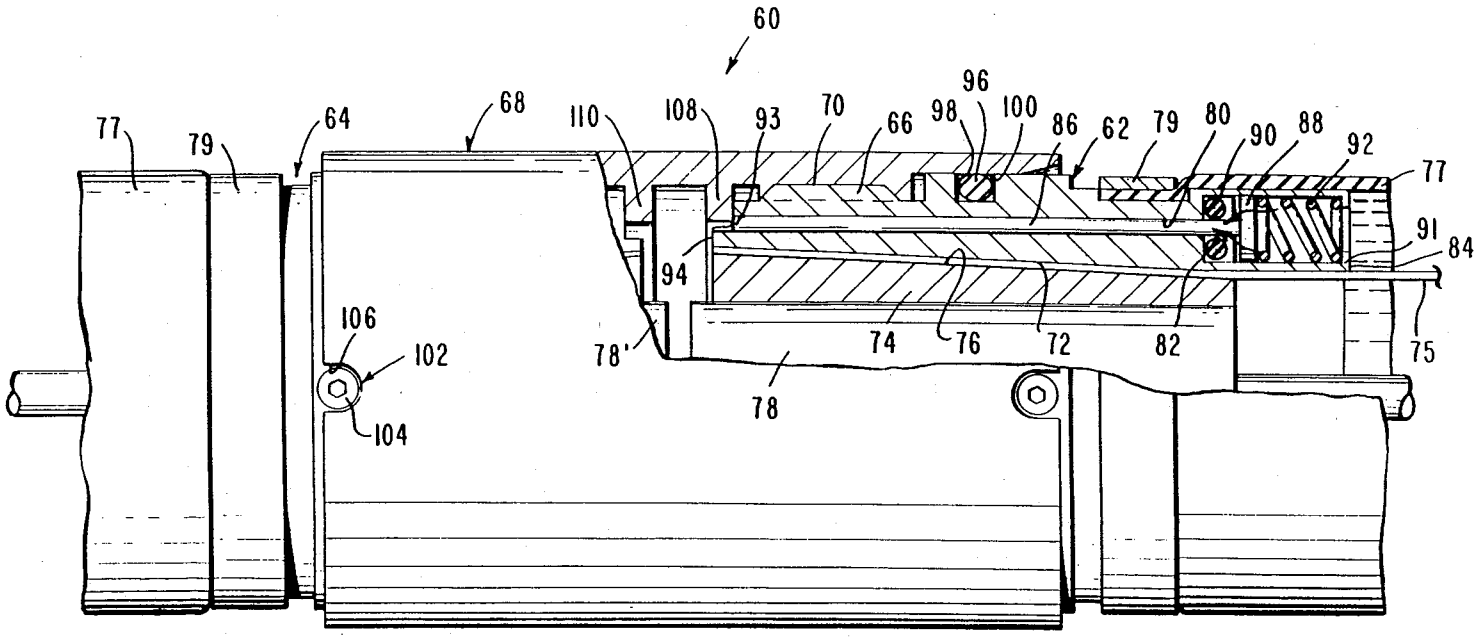
FIG. 5 is a view of the preferred embodiment, similar to that of FIG. 2, but in fully coupled position.

Coupling 68 is completed by a pair of inwardly extending annular shoulders 108 and 110 (see also FIG. 4). While only one shoulder is necessary, two are used so that coupling 68 is fully symmetrical. Annular shoulder 108 or 110 engages front end 93 of valve stem 86 to force the valve stem backward against the bias of spring 92, as shown in FIG. 5, to open communication between the front and rear faces 94 and 84 of header 62, and thereby to permit the fill fluid within the hose to flow through bore 80 between the respective mating faces of connectors 78 of their respective headers 62 and 64 as sea pressure bears against hose 77.

Although the invention has been described with reference to particular embodiments thereof, it should be realized that various changes and modifications may be made therein without departing from the spirit and scope of the invention.

What is claimed is:

1. A pressure compensated underwater intermodule coupling mechanism comprising:

a pair of connectors adapted to be coupled at their mating faces;

insulative fluid filled hoses and electromagnetic signal carrying conductors therein respectively coupled to and terminated by said connectors, and subject to being sgueezed by underwater pressure exerted on said hoses;

a fluid path incorporating a normally closed valve in at least one of said connectors and extending between its fluid filled hose and its connector mating face and including a movable element, sealing means and at least one groove;

an outer shell enclosing said movable element with said sealing means carried by one of said shell and said movable element and sandwiched therebetween, and said one groove being in the other of said shell and said movable element adjacent said sealing means;

a valve-opening member at said mating face of said other connector contactable with said movable element of said valve when said connectors are joined, to cause said sealing means to be positioned at said groove and to permit the underwater pressure to sgueeze said hoses to force the fluid to flow through said groove and around said sealing means from at least one of said hoses to said mating faces to egualize the underwater pressure exerted on and in the joint between said connectors.

2. A mechanism according to claim 1 further including resilient means operable on said movable element for biasing said movable element normally into closure of said valve opening.

3. A pressure-compensated underwater intermodule coupling mechanism comprising:

a pair of connectors adapted to be coupled at their mating faces;

insulative fluid-filled hoses and electromagnetic signal-carrying conductors therein respectively coupled to and terminated by said connectors, and subject to being sgueezed by underwater pressure exerted on said hoses;

a fluid path incorporating a normally closed valve in at least one of said connectors and extending between its fluid-filled hose and its connector mating face and including a movable element, sealing means, and at least one groove provided with an inwardly open portion;

a valve-opening member at said mating face of said other connector contactable with said movable element of said value when said connectors are joined, to cause said sealing means to be positioned adjacent to the open portion of said groove, thereby to permit the underwater pressure to sgueeze said hoses to force the fluid to flow through said groove and around said sealing means from at least one of said hoses to said mating faces to egualize the underwater pressure exerted on and in the joint between said connectors; and outer shells, one shell enclosing said movable element and the other shell secured to said valve-opening member, means on said shells for threaded engagement therebetween, openings in said movable element and said valve-opening member respectively for retaining said connectors, with said groove being in said outer shell which encloses said movable element, and means in said movable element retaining said sealing means adjacent the open portion of said groove.

4. A mechanism according to claim 3 further including resilient means operable on said movable element for biasing said movable element normally into closure of said valve opening.

5. A pressure compensated underwater intermodule coupling mechanism comprising:

a pair of connectors which are to be coupled at their mating faces by electromagnetic signal connection means;

insulative fluid-filled hoses and electromagnetic signal carrying conductors therein respectively coupled to and terminated by said signal connection means of said connectors, and subject to being sgueezed by underwater pressure exerted on said hoses;

a fluid path incorporating a normally closed valve associated with at least one of said connectors and extending between its fluid filled hose and its connector mating face; and a valve-opening member associated with said mating face of said other connector and contactable with said valve when said connectors are joined for opening said valve and for permitting the underwater pressure squeezing said hoses to cause flow of the fluid from at least one of said hoses to said mating faces to egualize the underwater pressure exerted on and in the joint between said connectors.

6. A mechanism according to claim 5 in which said valve comprises a movable element, sealing means and a stationary valve opening, in which said movable element is adapted to be contacted by said valve opening member.

7. A mechanism according to claim 6 further including resilient means operable on said movable element for biasing said movable element normally into closure of said valve opening.

8. A mechanism according to claim 5 in which said valve comprises a valve seat in said fluid path and a movable element having means sealable against said valve seat.

9. A mechanism according to claim 8 in which said valve further includes a stem secured to said movable element and adapted to be contacted by said valve-opening member.

10. A mechanism according to claim 9 further including resilient means biasing said movable element normally against said valve seat.

11. A mechanism according to claim 9 further comprising:

a pair of module headers including means for retaining said connectors respectively therein; and a bore in one of said headers forming a section of said fluid path, said bore reciprocally receiving said stem, and having an opening adjacent said connector mating face.

12. A mechanism according to claim 11 in which said stem has an end adjacent said bore opening and said valve opening member comprises a projection for contacting said stem end.

13. A mechanism according to claim 11 further including resilient means biasing said moveable element normally against said valve seat.

14. A mechanism according to claim 13 in which said fluid path includes an opening coupled to its fluid filled hose and said bore and terminated by said valve seat for receiving said movable element and said resilient means.

15. A pressure compensated underwater connector mechanism comprising:

an insulative fluid-filled hose, subjected to being compressed by underwater pressures exerted thereon, and electromagnetic signal carrying conductors carried in said hose;

a connector terminating said conductors and said hose and adapted to be coupled by electromagnetic signal connection means at its connector mating face to mateable electromagnetic signal connection means at a connector mating face of a mating connector;

a fluid path incorporating a normally closed valve associated with said connector and extending between said fluid filled hose and said connector mating face; and a valve opening member adjacent to and contactable with said valve for opening said valve and for permitting the underwater pressures exerted on said hose to cause flow of the fluid from said hose to said mating face to equalize the underwater pressures exerted thereon.

16. A mechanism according to claim 15 further including a closure member adapted to seal said connector at its mating face, and incorporating said valve opening member.

17. A mechanism according to claim 16 wherein said closure member comprises a second connector terminating a second insulative fluid filled hose and electromagnetic signal carrying conductors therein, said second conductor being adapted to be electrically coupled with said first-mentioned conductor.

18. A pressure compensated underwater intermodule coupling mechanism comprising:

first and second outer shells having respective inner surfaces;

a first block enclosed within said first shell and held relatively immobile therein;

a second block enclosed within said second shell and longitudinally movable relative thereto and including an exterior surface;

a pair of connectors held respectively within said first and second blocks and adapted to be coupled at their mating faces;

first and second insulative fluid filled hoses subject to being sgueezed by underwater pressure;

electromagnetic signal-carrying conductors in said hoses and respectively coupled to said first and second shells and blocks and terminated by said connectors;

a fluid path incorporating a normally closed valve positioned between said second shell and said second block and extending between said second fluid filled hose and its connector mating face and including an O-ring retained within a groove in said exterior surface of said second block, and in contact with said second outer shell inner surface, and at least one longitudinally extending groove placed within said interior surface of said second shell;

a valve opening protuberance extending from said mating face of said first block and contactable with said second block when said connectors are joined, to cause said O-ring to be positioned at said longitudinally extending groove and to permit the underwater pressure to sgueeze said hoses to force the fluid to flow through said longitudinally extending groove and around said O-ring from one of said hoses to said mating faces to egualize the underwater pressure exerted on and in the joint between said connectors.

19. A pressure compensated underwater intermodule coupling mechanism comprising:

a pair of module headers having front and rear ends, each of said front ends having outer surfaces with annular threads thereon;

a pair of connectors held in said headers and adapted to be coupled at their mating faces;

insulative fluid filled hoses respectively secured to said rear ends of said headers and subject to being sgueezed by underwater pressure;

electromagnetic signal carrying conductors in said hoses respectively coupled to and terminated by said connectors;

a fluid path incorporating a normally closed valve in at least on of said headers and extending between its fluid filled hose and its connector mating face and including a large bore terminated by a bottom surface, a small bore extending from said bottom surface and said large bore, a movable valve stem in said small bore, a valve head in said large bore terminating said stem, an O-ring positioned about said stem and between said valve head and said bottom surface, and a spring biasing said head into sealing contact of said O-ring against said bottom surface;

a tubular coupling having an inner surface terminated at its ends with annular threads for threaded engagement with said annular threads of said module headers;

at least one inwardly extending annular shoulder on said inner surface internal of said surface ends for contact with said valve stem when said connectors are joined, to cause said valve head and said O-ring to move away from said bottom surface and to permit the underwater pressure to sgueeze said hoses to force the fluid to flow through said large and small bores from at least one of said hoses to said mating faces to egualize the underwater pressure exerted on and in the joint between said connectors.

20. A mechanism according to claim 19 further including slots in said tubular coupling at its ends, and screws positionable in said slots and respectively in said module headers to enable said coupling and said headers to be non-rotatably secured together.

* * * * *